United States Patent [19]

Abbey

[11] 4,239,466

[45] Dec. 16, 1980

[54] ROTARY MACHINE WITH ADJUSTABLE MEANS FOR ITS ECCENTRIC ROTOR

[76] Inventor: Harold G. Abbey, 11 Goldsmith Dr., Holmdel, N.J. 07733

[21] Appl. No.: 5,479

[22] Filed: Jan. 22, 1979

Related U.S. Application Data

[63] Continuation-in-part of Ser. No. 586,925, Jun. 18, 1975, abandoned.

[51] Int. Cl.[3] ..... F04C 23/00; F04C 29/10

[52] U.S. Cl. ..... 418/11; 418/27; 418/29; 418/57; 418/61 R

[58] Field of Search ..... 418/27, 29, 57, 61 R, 418/63, 11, 8, 67

[56] References Cited

U.S. PATENT DOCUMENTS

| | | | |
|---|---|---|---|
| 724,224 | 3/1903 | Wiechmann | 418/57 |
| 1,075,590 | 10/1913 | Moors | 418/57 |
| 1,408,381 | 2/1922 | Moors | 418/57 |
| 1,692,639 | 11/1928 | Elsner | 418/57 |
| 1,961,592 | 6/1934 | Muller | 418/29 |
| 2,460,617 | 2/1949 | Balogh | 418/57 |

FOREIGN PATENT DOCUMENTS

| | | | |
|---|---|---|---|
| 2409232 | 10/1974 | Fed. Rep. of Germany | 418/57 |
| 571291 | 8/1945 | United Kingdom | 418/57 |

*Primary Examiner*—John J. Vrablik
*Attorney, Agent, or Firm*—Michael Ebert

[57] ABSTRACT

A rotating ring rotary compressor having a driven eccentric so mounted on the drive shaft that its eccentricity is adjustable from a minimum to a maximum, whereby at its maximum extension it presses the roller surface against the stator surface to cause it to roll around the stator with zero clearance and positive hermetic sealing. Because the extensible eccentric mounting is spring-biased, the resultant working pressure is controlled by the contribution of the spring bias to centrifugal force and any excess of pressure or interference causes the roller to reduce eccentricity, thereby internally bypassing excess pressure or overcoming interference.

10 Claims, 20 Drawing Figures

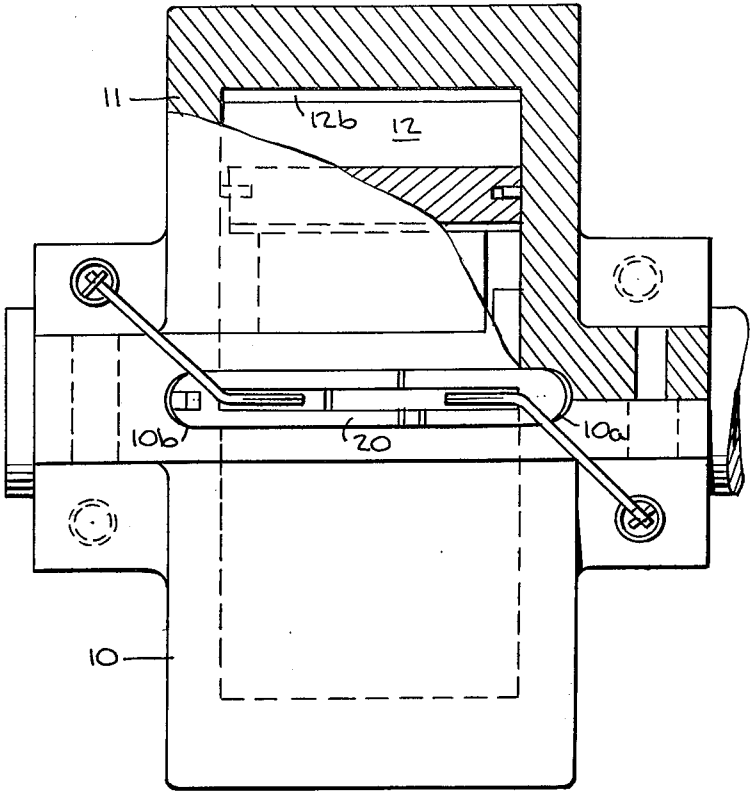
Fig. 3.
Fig. 2.
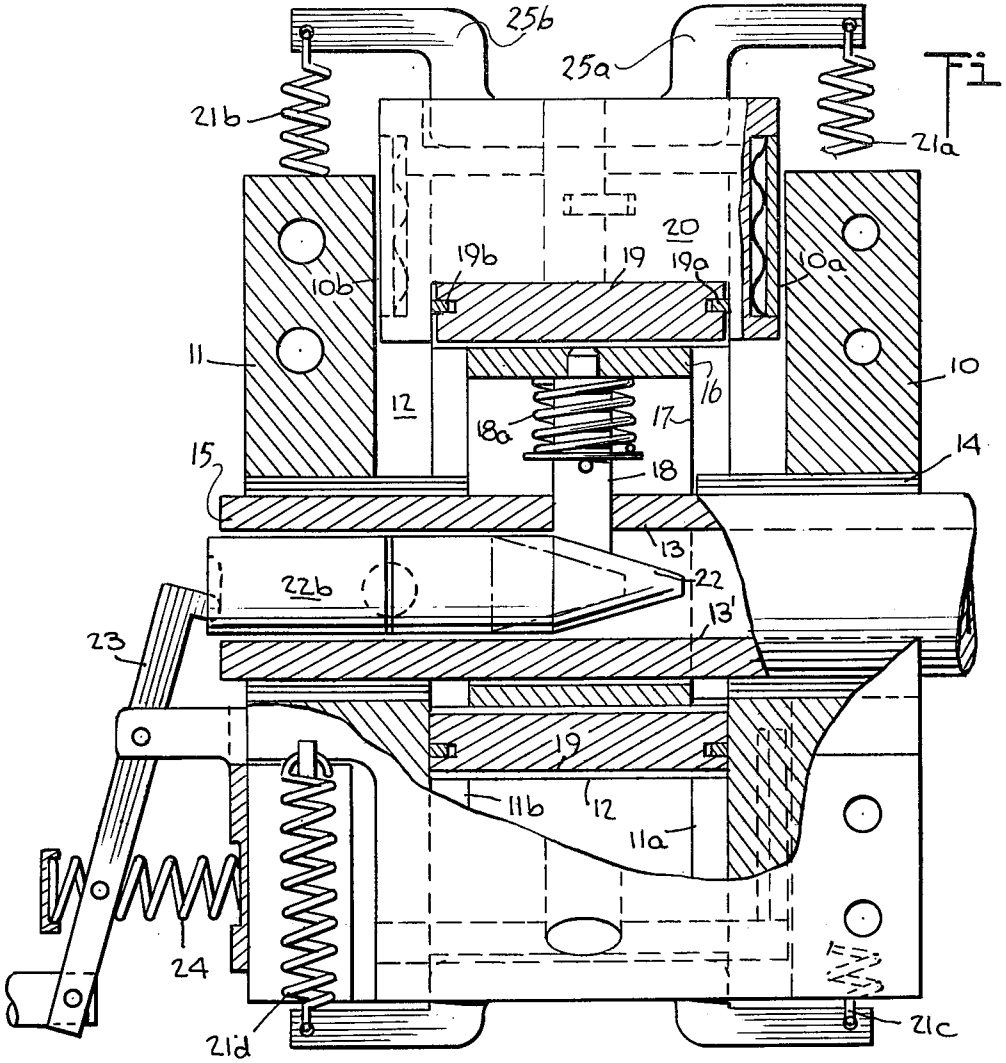

ROTARY MACHINE WITH ADJUSTABLE MEANS FOR ITS ECCENTRIC ROTOR

RELATED CASE

This application is a continuation-in-part of my copending application Ser. No. 586,925, filed June 18, 1975, now abandoned, entitled "Rotary Compressor," whose entire disclosure is incorporated herein by reference.

BACKGROUND OF INVENTION

This invention relates generally to compressors and pumps, and more particularly to improved compressors and pumps of the rotary type.

In the context of compressors, the term "rotary" signifies that compression is carried out by a structural arrangement employing circular instead of reciprocating motion. The characteristic form of existing rotary compressors is a direct-driven, positive sweeping mechanism. One well-known type of rotary compressor is the rolling ring-eccentric machine which employs a roller on a shaft-mounted eccentric, the roller surface being engaged by a spring-biased vane, which is caused to move in and out of the cylinder as the roller moves within its eccentric path.

A well-designed rotary compressor of the rolling eccentric type is relatively free from vibration and well-suited to high-speed operations. The performance of such rotary compressors is characterized by high volumetric efficiency due to the small clearance volume and corresponding low re-expansion losses inherent in their design. However, rotary compressors of the type heretofore known suffer from internal leakage which results in substantial losses and markedly reduces the efficiency of the unit.

In a rolling type compressor as well as in an eccentric piston type compressor which functions in a similar manner save that it makes use of a solid eccentric without a roller, a sliding vane serves to divide the chamber into a suction side and a high-pressure side.

But only the edge of the vane engages the moving surface of the roller while the sides of the vane do not. Their sealing, therefore, depends on close clearances or an oil film interposed between the surfaces. In a like manner, the outer cylindrical surface of the roller does not engage the inner cylindrical surface of the stator nor do the sides of the roller engage the sides of the stator. Here, also, the leakage is said to be controlled by "hydrodynamic" sealing whose major design requirements are minimum clearances and high speeds.

Effective hydrodynamic sealing is contingent on clearance, rotor speed, oil viscosity and the surface finish of the parts. But even with precisely machined parts, there is unavoidable leakage due to the presence of refrigerant diluted in the oil, which flows from the high-pressure side to the suction side of the machine. Similar internal leakage effects and a loss in efficiency are experienced with the sliding vane machine, for there, too, we find unsealed relative motion between the edges of the vanes and the cylinder walls.

Another disadvantage of existing types of rotary compressors is that one is unable to vary their capacity except by controlling rotational speed. This form of control adversely affects the efficiency of the unit.

In my above-identified copending application, there is disclosed a rotary compressor including a circular rotor eccentrically supported on a driven shaft which is coaxially disposed in a cylindrical cavity formed within a stator. The rotor acts as a crank with respect to a ring freely mounted thereon. The ring functions as a piston and is caused by the eccentric rotor crank to undergo orbital motion which cyclically moves it towards and away from the inner surface of the cylindrical stator.

The cylindrical cavity is partitioned into sealed compartments by means of divider blades. Each blade is linked to the ring and is slidable within grooves and a slot formed in the stator, the inner edge of the blade engaging the surface of the ring. As the ring-piston is driven through its orbit, it strokes into and out of each cavity compartment to vary the volume of the compartment whose confining surfaces are defined by the stator, the divider blades and the surface of the ring-piston. Each compartment is provided with a suction intake and a discharge outlet so that as the piston strokes the compartment, gas is alternately drawn in, compressed and discharged.

Also disclosed in my copending application are means to provide a compressor whose capacity may be controlled either at a constant speed or by speed control without loss of efficiency. The concern of the present invention is with an improved mechanism for effecting capacity control.

In all forms of rotary compressors wherein compression is carried out by an eccentric rotor and stator arrangement and, in particular, those that employ a freely-mounted cylindrical ring on a shaft supported eccentrically therein (referred to as the roller), the roller surface is engaged by one or more spring-biased vanes. In my copending application, linked blades are slidably mounted in grooves and slots, the roller surface having peripheral clearance with the inner cylindrical surface of the stator. Such clearance is inherent in the design to avoid interference and jamming from thermal and mechanical causes.

SUMMARY OF INVENTION

In view of the foregoing, the main object of this invention is to provide rolling ring compressors or pumps with a driven eccentric so-mounted on the driven shaft that its eccentricity is adjustable from a minimum to a maximum, whereby at its maximum extension it presses the roller surface against the stator surface to cause it to roll around the stator with zero clearance and positive hermetic sealing.

An important feature of this extendible eccentric is that its mounting is spring-biased so that the working pressure is controlled by this addition to centrifugal force, whereby any excess of pressure or interference causes the roller to reduce eccentricity, thus internally bypassing excess pressure or overcoming interference.

This feature together with the use of resilient semi-rigid, low-friction materials for one of the mating surfaces overcomes machining inaccuracy, surface imperfections and foreign particles or refrigerant slugs, and it acts as a load-limiting and constant pressure variable capacity compressor or pump.

Another feature of this invention is the utilization of the same eccentric adjusting and mounting mechanism for providing "unloaded" starts and capacity control with the attendant energy savings and durability improvement.

Another object of this invention is to provide a form of stator construction that simplifies and makes practical the manufacture and assembly of rotary compressors which incorporate the above-noted improvements and without which the production of such units would be costly, if not entirely impractical.

OUTLINE OF DRAWINGS

For a better understanding of the invention as well as other objects and further features thereof, reference is made to the following detailed description to be read in conjunction with the accompanying drawings, wherein:

FIG. 2 is a longitudinal section taken through the rotary compressor;

FIG. 3 is a plan view of the compressor;

DESCRIPTION OF INVENTION

First Embodiment

Figure 4:
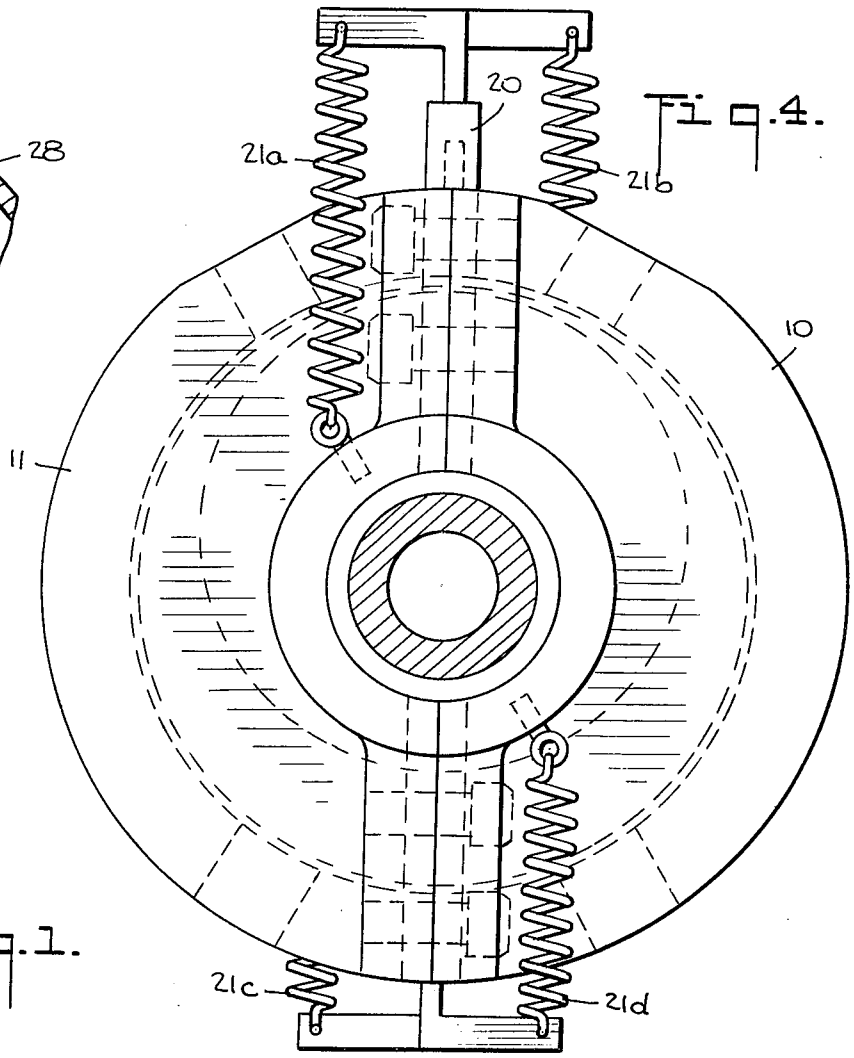
FIG. 4 is a transverse view of the stator and assembly of the compressor.

Referring now to the drawings and in particular to FIGS. 1, 2, 3, and 4, there is illustrated a rotary compressor unit in accordance with the invention, the unit having a pair of working compartments.

Mounted coaxially within stator cavity 12 is a driven shaft 13 which is supported for rotation by bearings 14 and 15 received within sockets formed by housings 10 and 11. The shaft is driven by a suitable motor (not shown) operatively coupled to the drive side thereof. Driven shaft 13 is so constructed that it has a hollow interior 14 and a flattened section 13 A and B. The body of rotor 16 is provided with a slot 17 having an elongated, generally rectangular form adapted to accommodate the flattened sections 13 A and B of driven shaft 13 on which the rotor is mounted and rotationally keyed.

Thus rotor 16 acts as a crank for loose ring roller 19 and is shiftable with respect to shaft 13 by the extension of pin 18 as positioned by tapered rod 22 located in the hollow center 13' of shaft 13. In order to obtain a change in rotor eccentricity (hence stroke) while the rotor is turning, cam rod 22 is positioned axially by lever 23 through a nonrotational element 22B and is biased by helical spring 24. Lever 23 is moved by governing means (not shown) against spring 24. When rotating, a centrifugal force proportional to the eccentricity of the rotor will tend to force crank 16 and ring-roller 19 outward to a maximum which is at contact of roller 19 surface with the stator surface 12 A and B. However, as soon as compression of the working fluid begins, the counter force will tend to oppose the centrifugal force. Hence a biasing spring 18A inserted between rotor 16 and shaft 13, alone or in combination with the force of spring 24 acting through cam-rod 22, is designed to counteract the working pressure of the unit.

The dimensions of rotor slot 17 are such that there is no clearance between the zenith of rotor-ring 19 and the inner cylindrical surface of stator 12. This inner surface is lined with a semi-rigid, low friction material 12 A and B so that the roller pressure against liners 12 A and B provide positive hermetic sealing, and together with the resilient spring-biased mounting provides automatic retraction of the roller without any interferences, such as foreign particles, or temporary slugs and effectively limits the compression pressure by this internal bypass.

When the rotor is centered within the cavity and rotates, the volume of each compartment A and B remains unchanged in the course of rotation and the compressor capacity is zero. When, however, the rotor is displaced from center and is therefore eccentric, in the course of rotation the displaced volume of each compartment undergoes a change to produce some degree of compression in the gas admitted thereto. The capacity of the unit to compress is raised as one increases the degree of eccentricity and stroke, until the maximum is reached, as determined by the physical dimensions of the unit.

The angular setting of lever 23 is governed by a suitable sensor and transducer (not shown) which is responsive to a variable condition such as temperature, pressure or any other such changing condition which requires a change in compressor capacity.

Thus if the compressor is included in an air conditioning or heat pump system, changes in outdoor temperature and load may be sensed and converted by suitable transducers into a mechanical position to adjust the angular setting of the axle and thereby alter the degree of eccentricity and the capacity of the compressor without loss of efficiency. If, for example, the set point of the indoor air conditioning is 72° F. and the ambient temperature is 80° F., then the compressor unit will be adjusted automatically to a reduced capacity and reduced power, and will operate more continuously rather than very intermittently at maximum capacity and maximum power demand, as is the usual practice, in order to maintain the indoor temperature at 72° F. But if the outdoor temperature rises above 80° F., then the capacity of the system will be automatically increased to meet the greater demand and require only the power dictated by this load.

Furthermore, by the unloading capability of this invention, in automatic start-stop operation, the compressor control system provides for no-load starting effecting considerable energy savings and prolonging the working life of the compressor and its motor.

The cavity of the stator 10 and 11 is partitioned into two distinct compartments which are sealed from each other by means of two diametrically-opposed divider blades 20 and 21. These blades reciprocate in complementary guide grooves 10 A and B and 11 A and B formed by stator pair 10 and 11, so that the blades are always fully supported regardless of their degree of extension into the cavity.

Springs 21 a, b, c and d apply tension onto bars 25 a and b which are retained in slots in blades 20 and 21 and exert pressure on the blades to seal them to the roller surface.

It will be seen that each divider blade is provided with a pair of spaced feet straddling rotor ring 19. The blades are sealed within their guide grooves and slots, preferably by the means fully disclosed in U.S. Pat. No. 3,923,431. To insure complete hermetic isolation between the two semi-cylindrical compartments A and B defined within the cavity by blades 20 and 21, the edge of each blade has a suitable bearing surface or a separate biased bearing piece which physically engages with and seals to the outer surface of ring 19. Ring 19 is provided on either face with sealing rings 19A and 19B which contact the flat side surfaces of stator 10 and 11 to prevent leakage therethrough.

Figure 1:
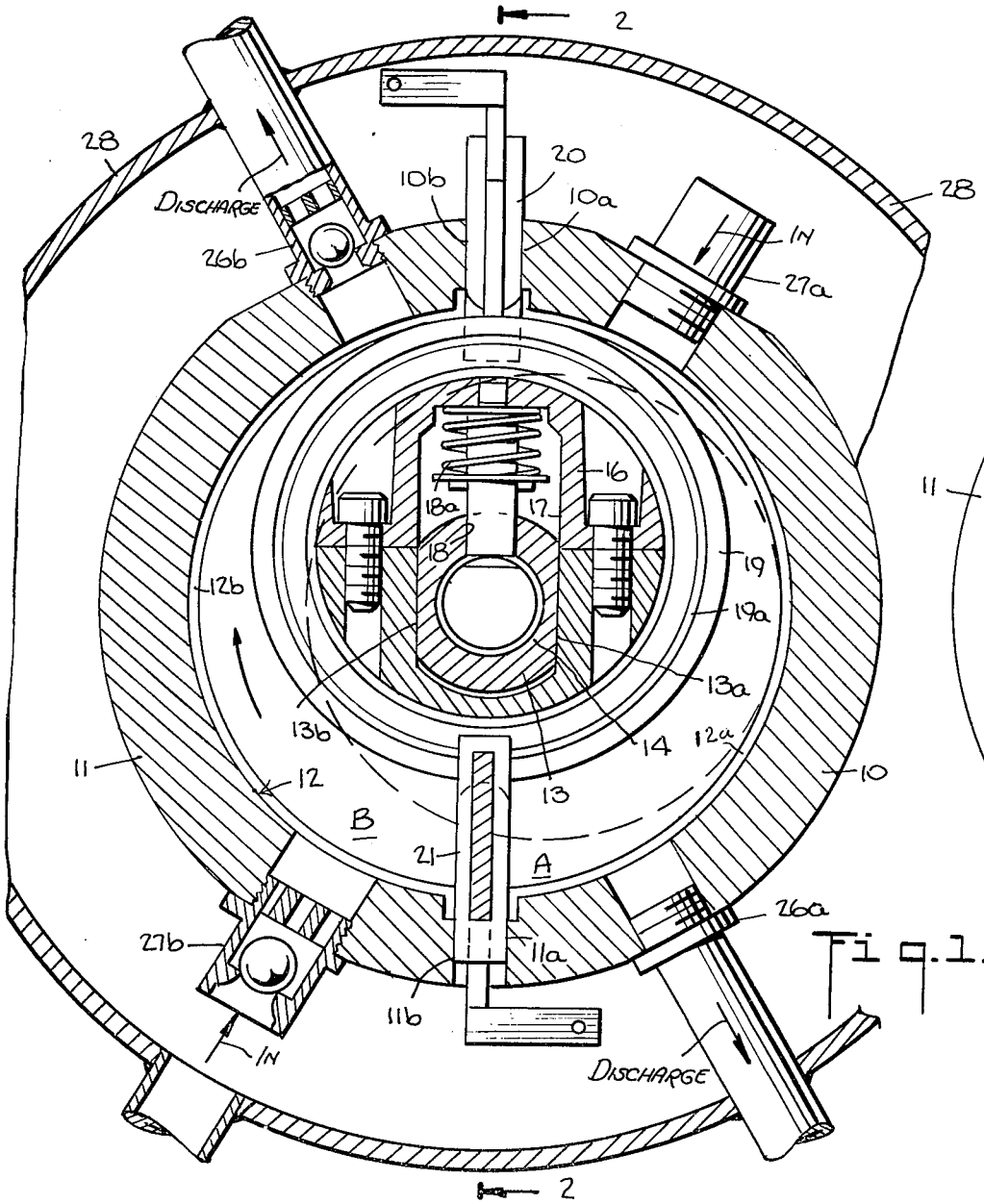
FIG. 1 is a transverse section taken through a first embodiment of a rotary compressor in accordance with the invention.
Figure 6:
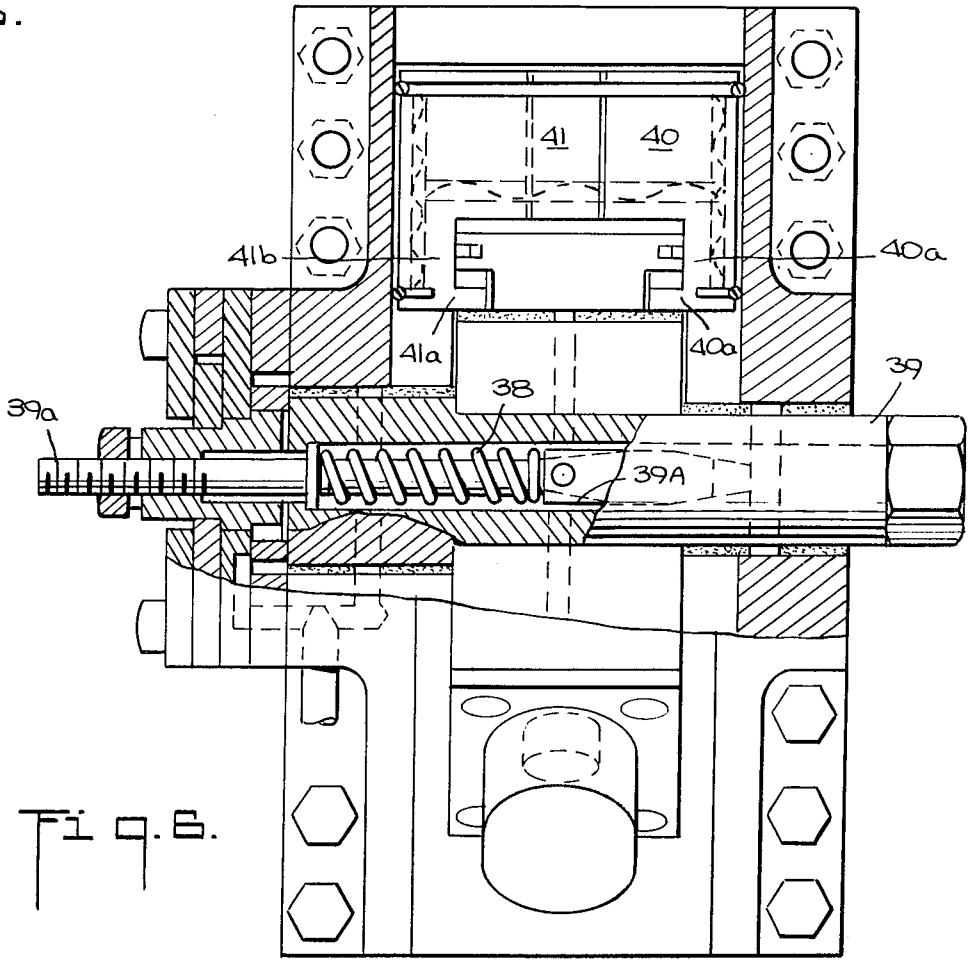
FIG. 6 is a longitudinal section of this embodiment.

With reference to FIG. 1 and the position of the parts as illustrated therein, in the course of each revolution of rotor 16, ring 17 is caused to travel through its orbit and acts as a piston which, as rotor 16 rotates 180° in the clockwise direction, ring 17 moves away from stator section 10 and acts to suck gas into compartment B through intake valve 27B. Then in the next 180° of rotation, the gas is compressed by the piston and is discharged from the compartment through discharge valve 26B and the cycle repeats. A similar action resulting from the changing volume of the compartment takes place simultaneously in compartment A with respect to intake valve 27A and discharge valve 26B, but in the opposite phase from that in compartment B.

This operation is analogous to that of a double acting reciprocating piston compressor; for the free ring acts as a piston which is stroked into each semi-cylindrical compartment by the eccentric rotor movement of the ring surface thereof which is canted in a direction opposite to the direction of rotation. Thus the arrangement fulfills all the criteria for positive displacement compressors but without reciprocating motion and its attendant disadvantages. The arrangement also retains all advantages of rotary compressors without the limitations of the prior art.

The entire assembled unit consisting of compressor and motor (not shown) is mountable in a metal container 28 through which suitable metal tubes coupled to the discharge valves 26 A and B and to the interior as a plenum for the intake valves 27 A and B.

Second Embodiment

In the embodiment shown in FIGS. 5, 6, 7 and 8, there is a similar construction of the adjustable crank-roller piston arrangement.

In this embodiment, the compressor is arranged for full capacity at all times but with pressure limiting by means of an adjusting screw 39A set to compress spring 38 to the required operating pressure acting through cam-rod 39 and pin 37 on crank 36 and roller 37.

Feet **40*b* and 41*b* of blade 40 and 41 are provided with pins or rollers 40A and 41A which project into the shoulder formed between ring 37 and rotor 36**. The width of the peripheral part of the ring is substantially equal to the width of the cavity, whereas the width of the inner portion is is narrower than that of the cavity whereby the rollers engage the undersurface of the ring and serve to link the blade to the ring.

In this embodiment, the axially split stator housing is provided with external valves 42 and 43 and blade slot caps 29 for semi-hermetic assembly. Drive shaft 39 is so constructed that the diameter of the journal at one end is equal to or less than the width of the flattened section to allow the assembly of one (1) piece rotor crank 36.

Figure 9:
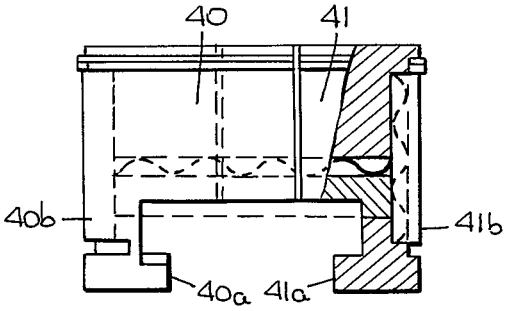
FIG. 9 is a longitudinal view of a linked blade in accordance with this invention.

FIG. 9 shows a longitudinal view of a split blade construction with feet formed to link with the underside of the ring-roller. The dividing of the blade by means of a tongue and groove joint is necessary for the assembly of such blades to their rollers and to complete their hermetic sealing by allowing the straddling feet to apply pressure to the sides of the roller as created by the spring-biased bar seals on each side.

Figure 10:
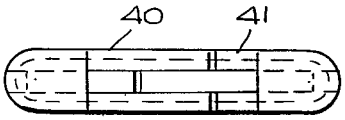
FIG. 10 is a bottom view of the divider blade.

FIG. 10 shows a tongue and groove joint so constructed that there is interior clearance for this purpose.

Figure 11:
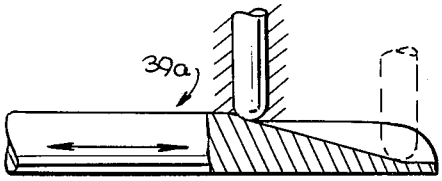
FIG. 11 is a longitudinal view of the cam rod in this embodiment.

FIG. 11 is a view of the cam end of cam-rod 39.

Figure 13:
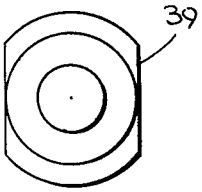
FIG. 13 is a transverse view of this shaft.
Figure 12:
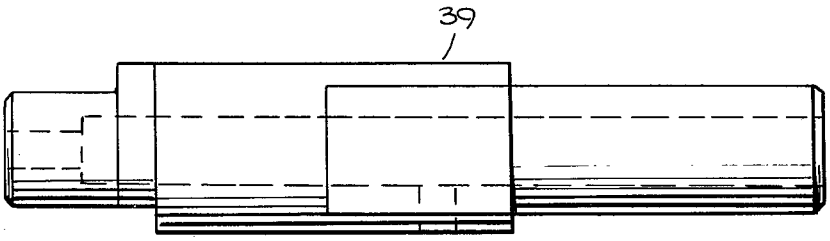
FIG. 12 is a longitudinal view of the driven shaft in this embodiment.

FIGS. 12 and 13 are views of a typical shaft construction for a one-piece slotted crank-rotor with provisions on one end for lubricant pump.

Third Embodiment

Figure 14:
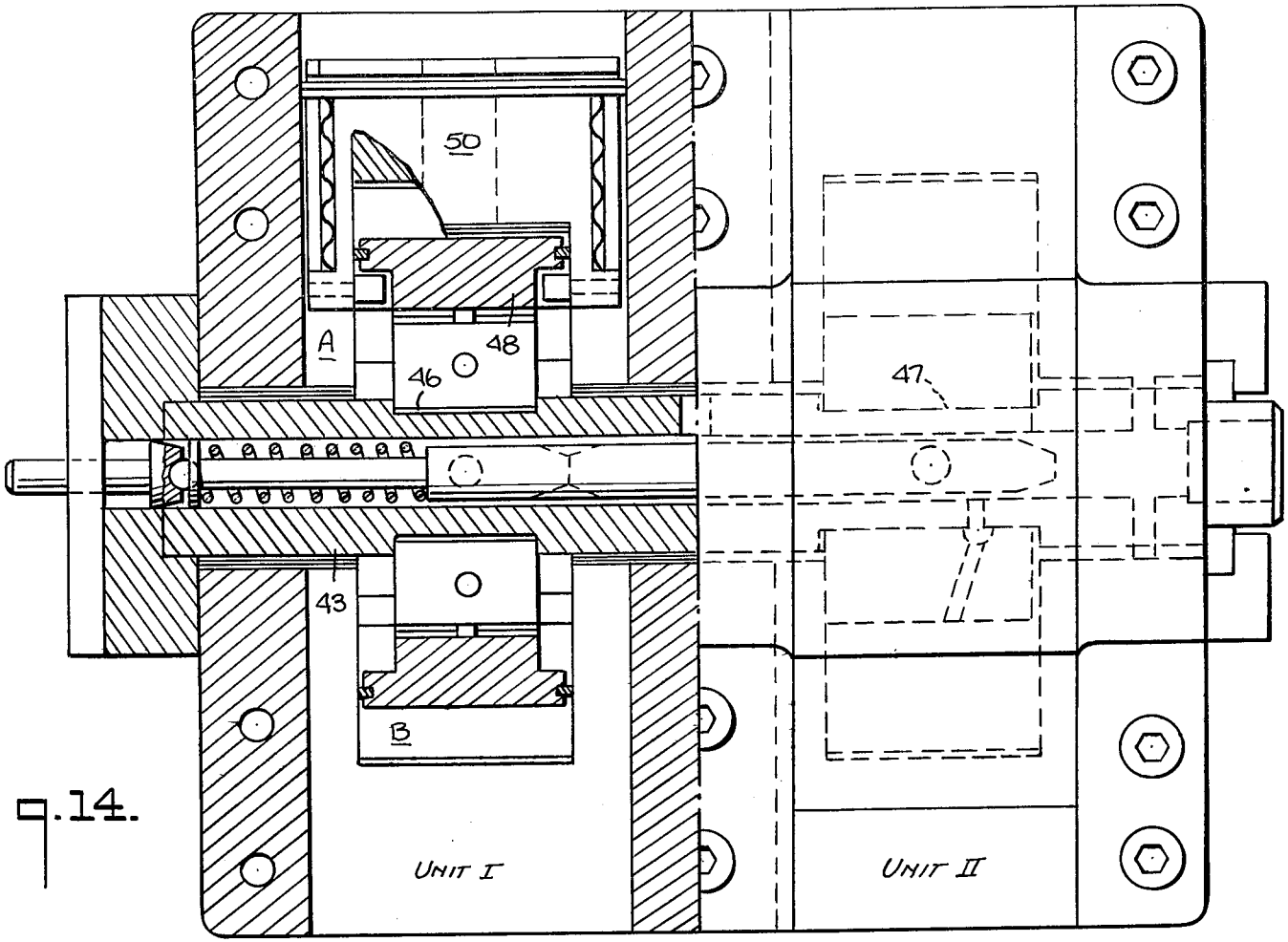
FIG. 14 is a longitudinal section and view of a third embodiment of this invention.
Figure 15:
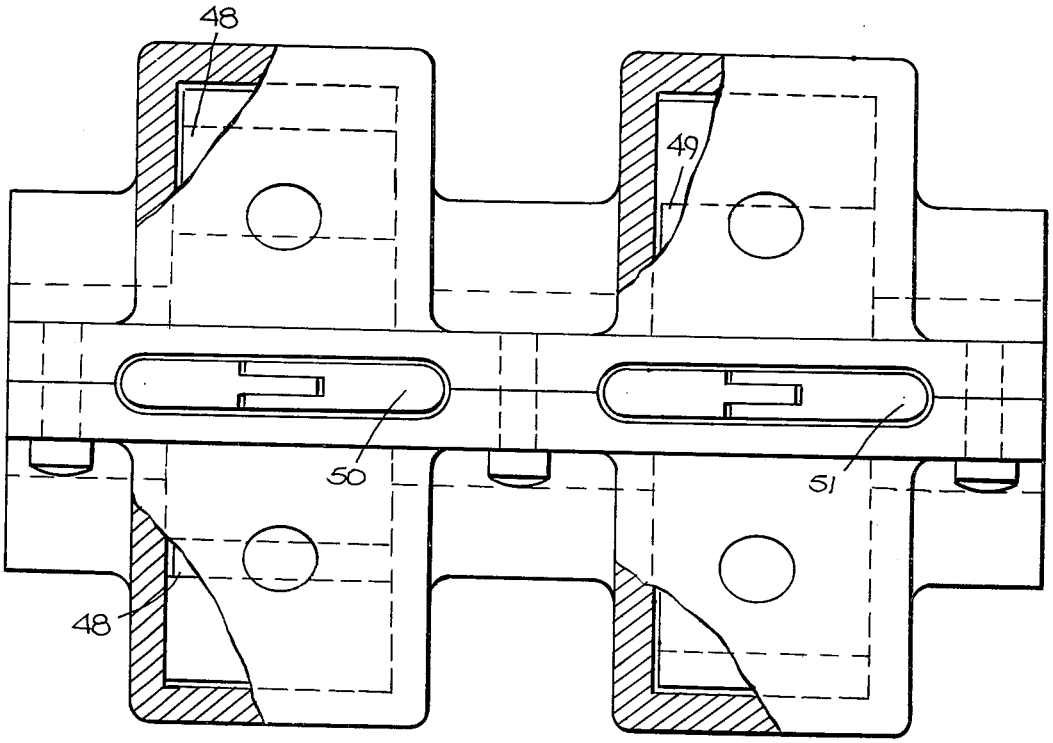
FIG. 15 is a plan view of this embodiment.
Figure 16:
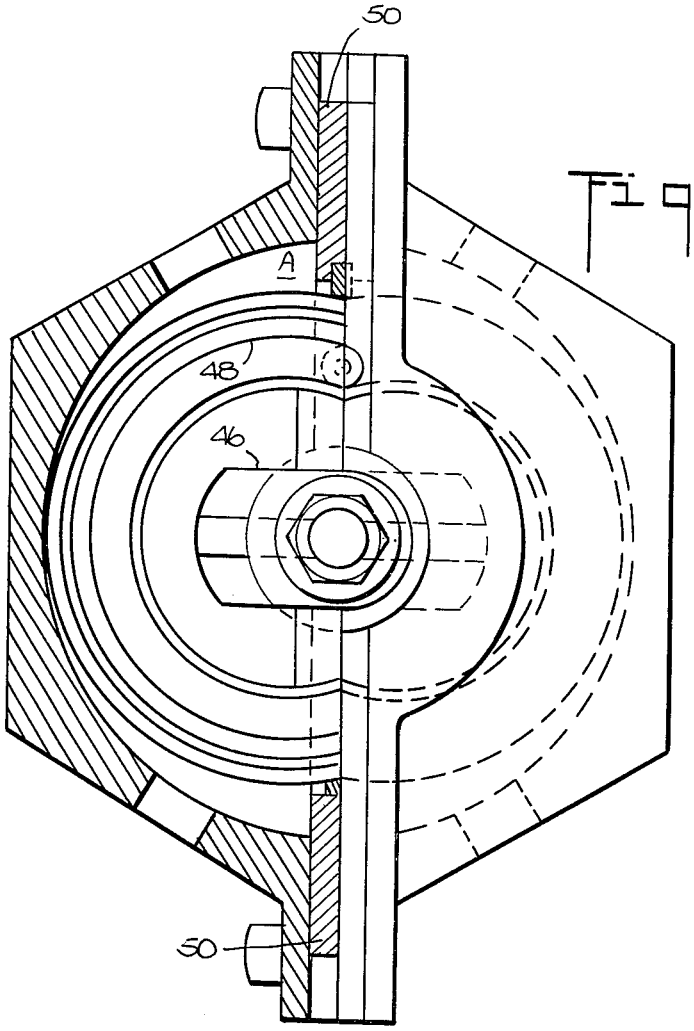
FIG. 16 is a transverse section and plan view of this embodiment.

In the embodiment shown in FIGS. 14, 15 and 16, two units, generally designated as Unit I and Unit II, are provided. Each of these units is identical to the single unit shown in FIGS. 5 and 6 and includes a shaft 43 on which rotors 46 and 47 are eccentrically mounted, the rotor causing rings 48 and 49 to move in an orbital path and to reciprocate divider blades 50 and 51 linked thereto and move inwardly and outwardly with respect to the compartment formed thereby, thus varying the volume of each compartment from a minimum clearance to a maximum value. Each of compartments A and B defined by the blades is provided with inlet and discharge ports and with valves appropriate thereto.

The shafts 43 of both units I and II are axially aligned in a keyed or one-piece construction, the rotors and stators of the two units being oriented so that they are displaced 180° with respect to each other to effect both dynamic and static balancing without the use of external counterweights or other expedients. Since each unit has two working compartments, the tandem arrangement of two units functions effectively as a highly compact and efficient four-cylinder compressor.

Figure 17:
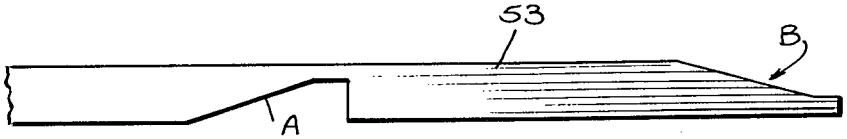
FIG. 17 is a longitudinal view of a cam rod in accordance with this embodiment.

FIG. 17 illustrates a cam-rod for use in the tandem unit of this embodiment wherein the rod 53 has two (2) cams A and B facing 180° apart to simultaneously act upon both rotors eccentrically phased 180°.

Figure 18:
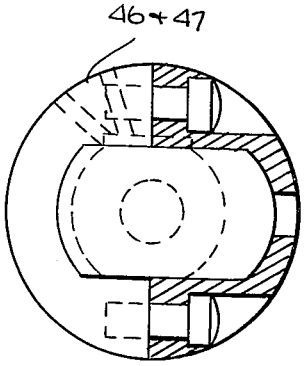
FIG. 18 is a transverse view of a split eccentric rotor in accordance with this invention.

FIG. 18 is two views of a typical slotted rotor that is divided in an axial plane on center into two parts which are bolted together upon assembly at the flattened section of the shaft.

Fourth Embodiment

It is known to use a rotary unit in a single fluid (air-to-air) refrigeration system, which unit includes compressor and expander sections and a heat exchanger disposed therebetween, the system employing a reversed Brayton cycle in operation.

Figure 5:
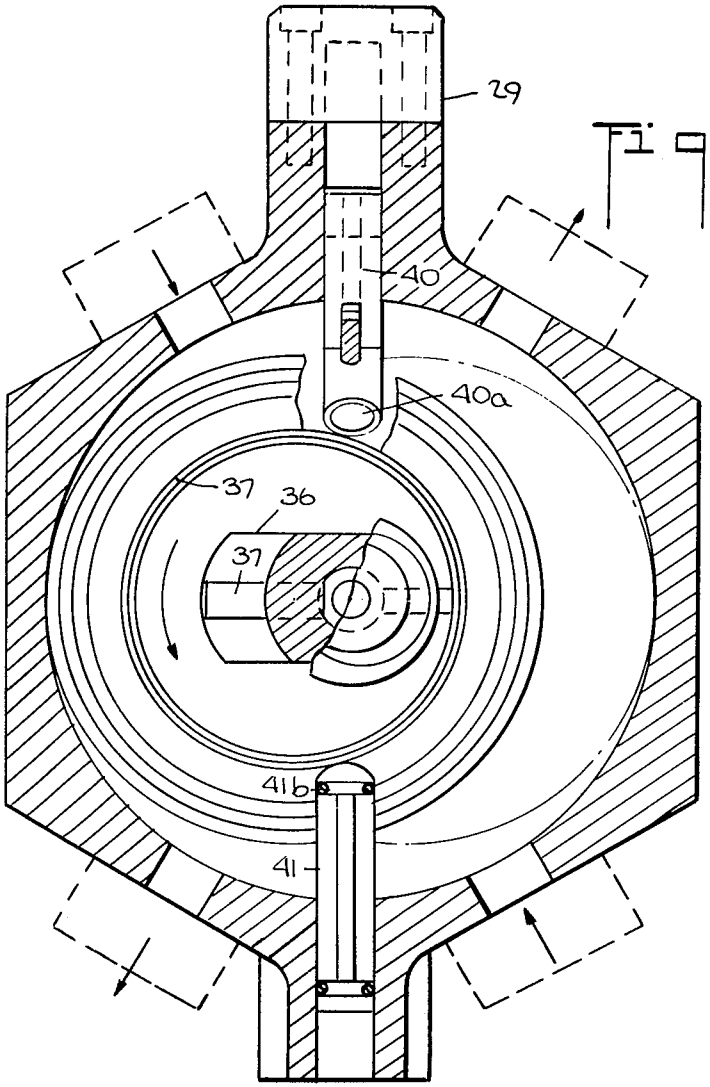
FIG. 5 is a transverse section taken through a second embodiment of the invention.
Figure 8:
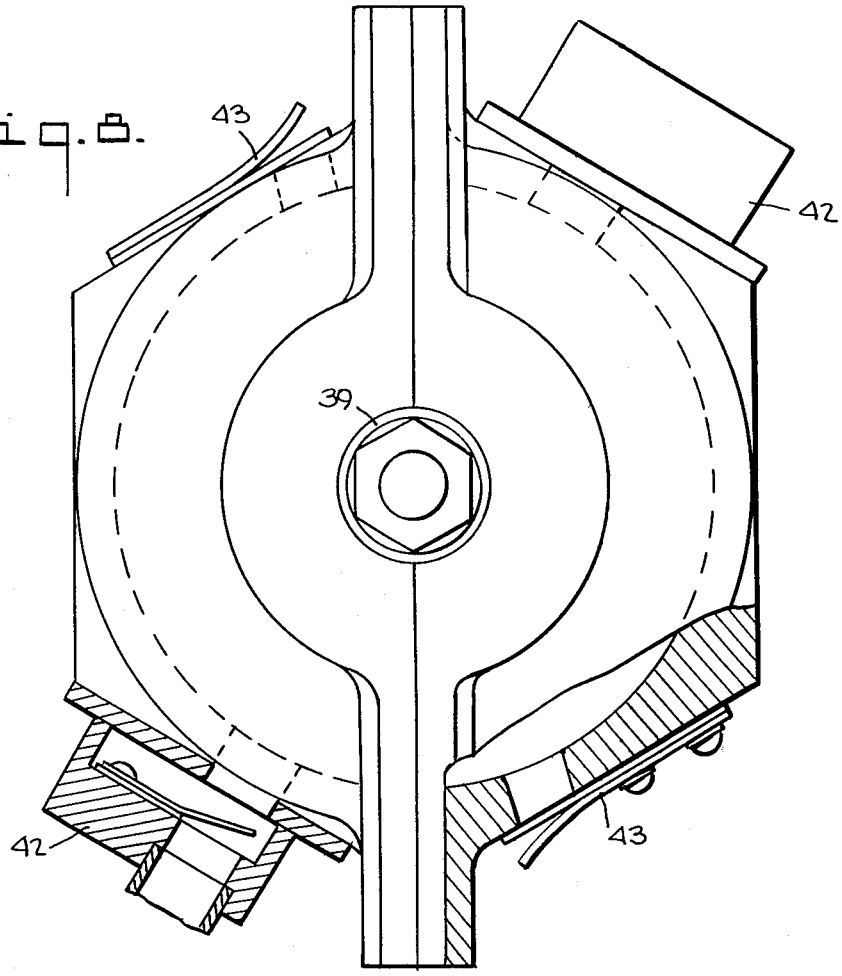
FIG. 8 is a transverse view of the assembly of this embodiment.
Figure 7:
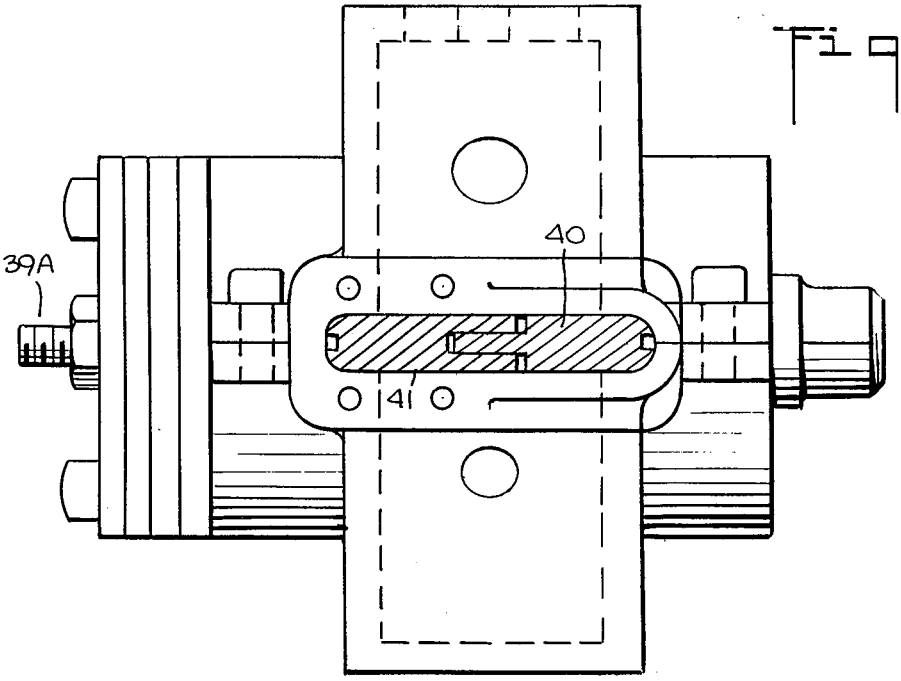
FIG. 7 is a plan view of this embodiment.
Figure 19:
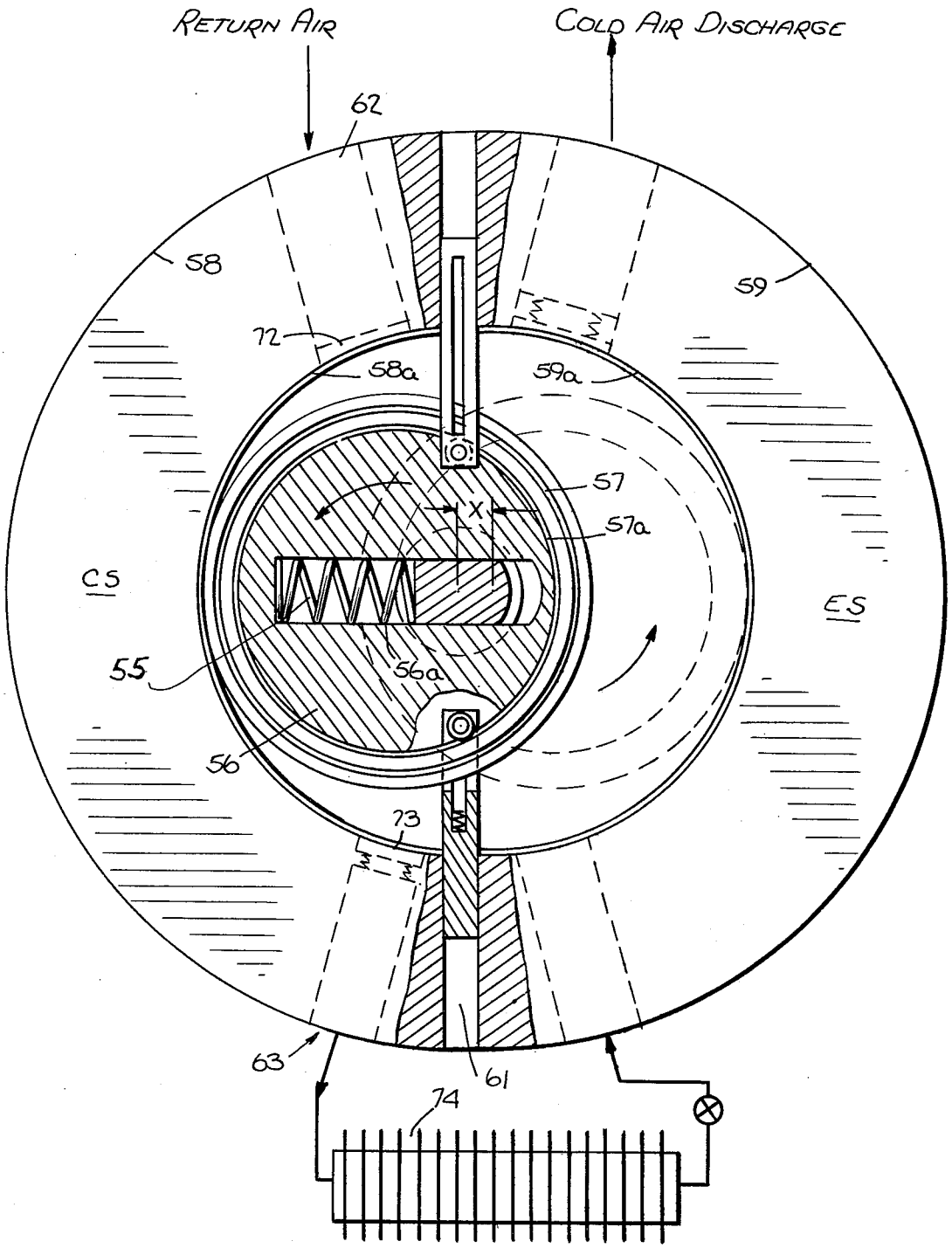
FIG. 19 is a transverse section of a fourth embodiment of this invention.

In the compressor-expander unit shown in FIG. 19 for use in a single fluid refrigeration system, the structure thereof is similar to that of the two-cylinder compressor shown in FIG. 5, except that the divider plates 60 and 61 partition the cylindrical cavity into a compressor sector CS and an expander section ES. Air to be cooled is admitted into inlet port 62 on the compressor side CS which is provided with an inlet valve 72, and compressed air is discharged from this side through an outlet 63 having a discharge valve 73.

The compressed air from outlet 63 of the compressor sector SC is fed through a heat exchanger 74 exposed to the atmosphere in the area outside the region to be cooled and from the exchanger into the intake 75 of the expander sector ES of the unit, cold air being discharged from outlet 76 of this sector.

Thus the air drawn from the region to be cooled is compressed in the compressor sector CS, as a result of which its temperature is increased substantially. This compressed and heated air is then forced through heat exchanger 74 which is exposed to outside air. The compressed air, which is now cooler, then enters the expander sector ES, and as the air expands to atmospheric pressure, it cools adiabatically to a cold temperature which is well below the temperature of the air drawn into the compressor sector. Going into the expander, a part of the heat/pressure energy is returned to the rotor. Thus in the expansion process, the air pays back a substantial portion of the power used to effect compression.

The advantage of this type of unit over a conventional Freon air conditioning system is that there is no high pressure gas to store and seal against leaks, or to replace. Moreover, the cool air system works very quickly, and cold air is produced without any significant time lag after the unit is put in operation. It is also to be recognized that the same unit, since it produces heat in the compressor sector, may be used as a heater, by bypassing the heat exchanger.

In this embodiment of a compressor-expander unit, the roller-ring 57 is always in rolling contact with the inside surface of stators 58 and 59 by means of spring 55 exerting pressure on the slideably mounted rotor outward from the driven shaft so that hermetic sealing is obtained between the roller surface and the resilient linings 58A and 59A.

In this embodiment, the expander space or compartment ES is larger than the compressor compartment Cs by the offset of its radius center "X", in effect making the stator oval.

Slot 56A of rotor 56 is of sufficient length to allow roller ring 57 to follow the inner surface of the stator and apply pressure on same.

The use of low friction materials for bearing at 57A, for blades 60 and 61 and linings 58A and 59A provides a dry, lubricant-free machine for contaminant-free processing of ambient air.

Best performance is obtained by two identical units with the rotor eccentrics connected in tandem with their zeniths at 180° apart but the housings assembled in line, providing two pressure pulses and two expansion pulses per revolution.

Fifth Embodiment

Figure 20:
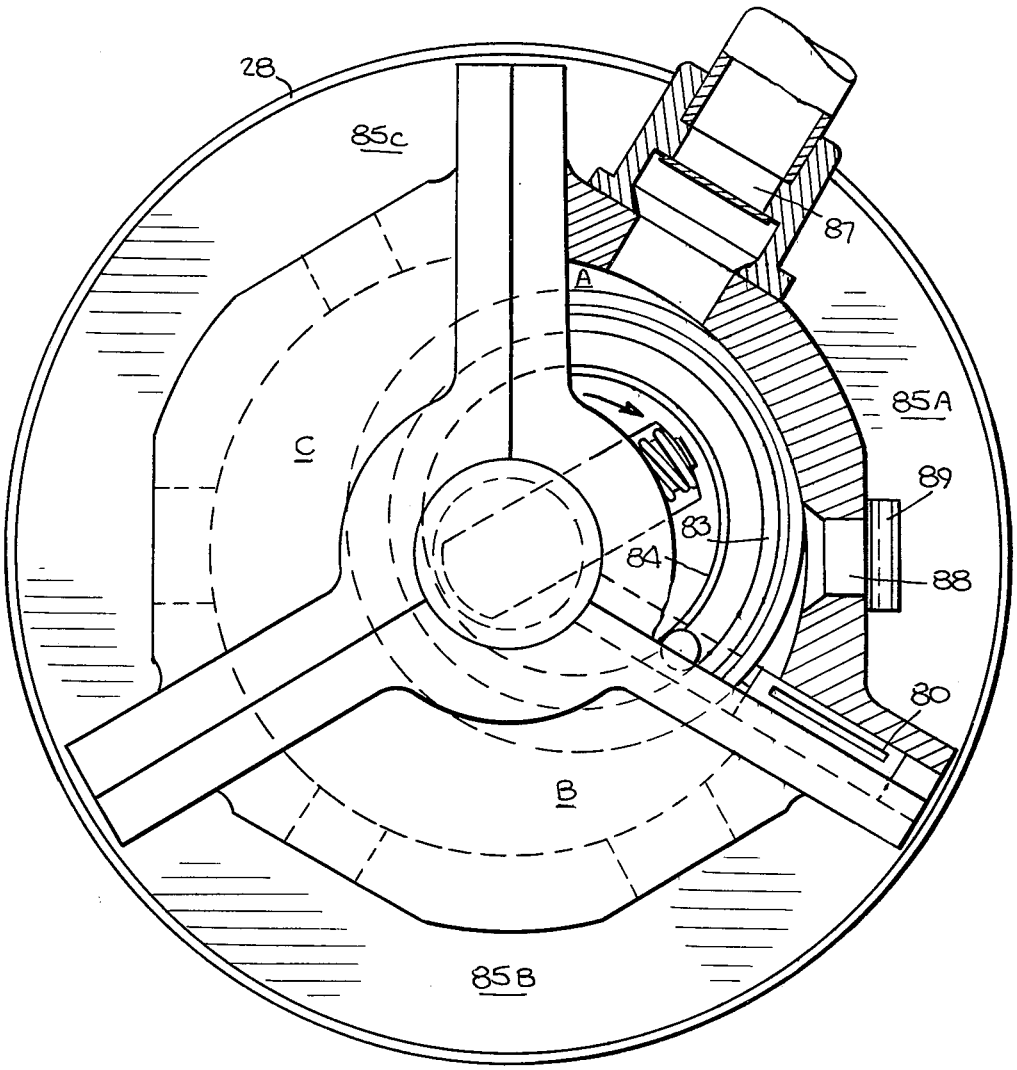
FIG. 20 is a transverse view and section of a fifth embodiment of this invention.

FIG. 20 is a transverse section and view of a three compartment unit.

The unit includes three identical divider blades 80 81 and 82 which are linked by rollers or pins to ring 83 freely mounted on rotor 84, the blades extending into the cylindrical cavity of stator blocks 85 A, B and C. The blades are disposed at 0°, 120° and 240°, respectively, thereby partitioning the cavity into three like sectors or compartments, A, B and C, each of which is provided with an intake port having a suction valve therein and an outlet port having a valve therein. Thus compartment A is provided with an intake port 86 and a suction valve 87 and with an outlet port 88 and a discharge valve 89. The details of this arrangement are similar to the two compartment unit shown in FIG. 5, except that it behaves as a three-cylinder compressor.

In this embodiment, it is to be noted that the stator is divided axially on the centerline of blade slots. Although equal compartments are shown, they may be unequal to provide for stage compression or evacuating or any desirable combination by the appropriate exterior manifolding of intakes and discharges. However, the method of construction of stator housings remains along the axial plane through the centerline of blade slots in any number of compartments, three or more as the application requires.

While there have been shown and described preferred embodiments of a rotary compressor in accordance with the invention, it will be appreciated that many changes and modifications may be made therein without, however, departing from the essential spirit thereof. Though it is the prime purpose of this invention to provide a machine that improves the efficiency and practicality of such rotary machines as "compressors," the principles of this invention are also fully applicable to such machines as "pumps."

The distinguishing characteristics of compressor machines lie in their use on compressible fluids such as air and gases. Machines used as pumps are those used for non-compressible fluids or liquids such as water, oils, and slurries. The application of the variable eccentric-crank disclosed herein provides variable volume-constant pressure performance from either multiple slipper type piston-cylinder units applied to the periphery of the loose ring rotor or by the rotor-piston action of the rotor itself. The distinction between compressors and pumps resides primarily in the design of the valves.

I claim:

1. In a rotary machine, the combination comprising:

(A) a stator provided with a cavity having a continuous inner wall;

(B) a driven shaft coaxially mounted in said cavity;

(C) a circular rotor supported on said shaft and having a ring freely mounted thereon, the rotor acting as a crank causing said ring, which functions as a piston, to undergo orbital motion in said cavity with its zenith in rolling contact with said inner wall, said rotor having a body provided internally with an elongated slot through which said shaft passes, said slot extending in a direction normal to the axis of said shaft;

(D) adjustable means to displace said rotor relative to said shaft from a zero position in which the axis of the rotor is aligned with the axis of the shaft to positions in which the rotor is eccentric with respect thereto within the limits of the slot, thereby to vary the eccentricity of said rotor and hence the capacity of the machine, said adjustable means including a bolt axially shiftable within a longitudinal bore in said shaft and terminating in a cam engaging one end of a pin disposed within said slot at right angles to said shaft, the other end of said pin engaging the inner wall of the rotor body in the middle portion along the width thereof whereby an axial shift of said bolt causes lateral displacement of said rotor relative to the shaft; and (E) a helical bias spring disposed in said slot and surrounding said pin to urge said rotor body against the ring to maintain the zenith of the ring in contact with the inner wall of the cavity throughout said orbital movement.

2. In a machine as set forth in claim 1, in which said slot has parallel walls and said shaft passing therethrough has flattened sides sliding on said walls.

3. In a machine as set forth in claim 1, further including lever means to vary the axial position of said bolt as a function of a sensed variable to adjust the capacity of the machine in accordance with said variable.

4. In a machine as set forth in claim 1, wherein said stator is constituted by a split housing.

5. In a machine as set forth in claim 1, further including spring-biased means to maintain said bolt in said shaft at a position providing a predetermined operating capacity.

6. A two-unit arrangement constituted by a pair of machines as set forth in claim 1 provided with a common shaft on which the rotors of the two machines are eccentrically mounted, the rotors and stators of the two machines being oriented so that they are displaced 180° with respect to each other to effect both dynamic and static balancing.

7. In a machine as set forth in claim 1, further including at least one divider blade slidable within said stator and extending into said cavity to divide the cavity into at least two distinct operating compartments.

8. In a machine as set forth in claim 7, further including fluid intake and output ports associated with each compartment.

9. In a machine as set forth in claim 7, wherein three divider blades are provided to partition the machine into three compartments.

10. In a machine as set forth in claim 7, wherein two divider blades are provided to partition the machine into two compartments.

* * * * *